US005382022A

United States Patent [19]

Cook et al.

[11] Patent Number: 5,382,022

[45] Date of Patent: Jan. 17, 1995

[54] GAME TABLE

[75] Inventors: Michael A. Cook, Blackburn North; Felix Sajn, Kew, both of Australia

[73] Assignee: Gamemasters Pty Ltd, Preston, Australia

[21] Appl. No.: 124,968

[22] Filed: Sep. 21, 1993

[30] Foreign Application Priority Data

Sep. 23, 1992 [AU] Australia ..... PL4873

[51] Int. Cl.[6] ..... A63B 67/14

[52] U.S. Cl. ..... 273/126 R; 273/118 R

[58] Field of Search ..... 273/118–127

[56] References Cited

U.S. PATENT DOCUMENTS

| | | | |
|---|---|---|---|
| 2,791,429 | 5/1957 | Perec et al. | 273/126 R |
| 3,156,467 | 11/1964 | Rucker | 273/126 R |
| 3,174,752 | 3/1965 | Plentis | 273/126 R |
| 3,219,349 | 11/1965 | Smith | 273/126 R |
| 4,017,079 | 4/1977 | Apellaniz | 273/126 R |
| 4,032,150 | 6/1977 | Wilson | 273/127 B X |
| 4,986,542 | 1/1991 | Bonnet | 273/126 R X |

FOREIGN PATENT DOCUMENTS

| | | | |
|---|---|---|---|
| 2430246 | 3/1980 | France | 273/126 R |
| 2322682 | 11/1974 | Germany | 273/126 R |

*Primary Examiner*—Vincent Millin
*Assistant Examiner*—Raleigh W. Chiu
*Attorney, Agent, or Firm*—Herbert Dubno

[57] ABSTRACT

A game table for table hockey has a planar playing surface bounded by walls, wherein the inner sides of the walls are lined with a layer comprising material having satisfactory sound deadening properties and being resilient enough to provide satisfactory rebound of an object when said object strikes the layer. The layer is composed of material selected from polyur ethane polymers having a durometer reading of 78±5% on the Shore D Scale or natural or synthetic rubbers having a durometer reading of 40±10% on the Shore A Scale.

9 Claims, 1 Drawing Sheet

GAME TABLE

FIELD OF THE INVENTION

This invention relates to improvements in game tables and more specifically to improvements aimed at reduction of noise emitted during the playing of table games such as table hockey.

BACKGROUND OF THE INVENTION

During a table game such as table hockey a puck of a hard, but preferably resilient, material is hit across a table surface bounded by raised edges (hereinafter called "raised inner sides") by several players using paddles. The aim of the game is to score goals by hitting the puck into one of a number of designated scoring areas. During the course of a game the puck usually collides with the raised inner sides of the table. Those collisions usually give rise to sounds, specifically loud dicks. The noise of these clicks can be irritating, especially when a number of such games are being played on tables in a confined area. It is a feature of a game such as table hockey that the puck be able to rebound off the raised inner sides of the game table so as to provide differing angles of attack on the designated scoring areas.

OBJECT OF THE INVENTION

It is an object of this objection to ameliorate the aforesaid noise problem without substantially reducing the rebound effect experienced at the raised inner sides of a game table.

SUMMARY OF THE INVENTION

According to one aspect of this invention the raised inner sides of a game table are lined with a layer comprising material having satisfactory sound deadening properties and resilient enough to provide satisfactory rebound of a puck when the puck strikes the layer. The layer is secured, either releasably or non-releasably, to the raised inner sides of a game table.

In a further aspect of the invention the said layer may be adhered to or otherwise bonded to the raised inner sides forming the boundaries of a game table. Alternatively the layer may be keyed into complementarily profiled recesses provided in the raised inner sides.

In one embodiment of the invention the sound-deadening material is comprised of a polyurethane polymer heat-bonded to, or sprayed onto, the raised inner sides of a game table. A suitable polyurethane polymer is that sold under the brand name POLYSPRAY. It has a durometer reading of 78±5% on the Shore D scale.

In another embodiment an improved raised inner side for a game table comprises a layer of natural or synthetic rubber having hardness falling within a predetermined range fixed to a raised inner side of a game table by means of adhesive material or by heat bonding. Suitable materials are selected from natural or synthetic rubbers having a durometer reading of 40±10% on the Shore A scale and may include those sold under the following brand names: T40CL, LINOTEX, CHUTEX, DECLINE.

While it may be possible to employ a rubber material having a durometer of reading of 55±10% on the Shore A scale, the service life of a layer comprising such material is unacceptably short. The material tends to break up readily and deteriorate. It has been found that nylon is an unacceptable material. It does not deaden the sound of the impact of the puck.

The layer should be more than 4 mm thick. Otherwise, during collisions with the sides of the game table the puck compresses the material in the said layer to such an extent that acceptable sound deadening is not provided because the said layer does not provide sufficient cushioning. Optionally, said layer is approximately 6 mm thick.

Preferably, the opposing face of said layer of sound-deadening material not fixed to the raised inner side is covered by a protective strip adhered to said layer. Reasons for providing said protective strip, which may be formed from a plastics material such as that used for backing conveyor belts, include the addition of physical strength especially where said layer comprises rubber by constraining the amount of deformation that can occur during a collision of a puck with said layer, by minimizing the frictional contact with said puck, and by reducing the opportunity for mechanical damage to said layer by vandalism.

BRIEF DESCRIPTION OF THE DRAWING

In order that the invention may be more dearly understood and readily put into effect, preferred non-limitative embodiments will now be described with reference to the accompanying drawing, in which.

SPECIFIC DESCRIPTION

Figure 1:
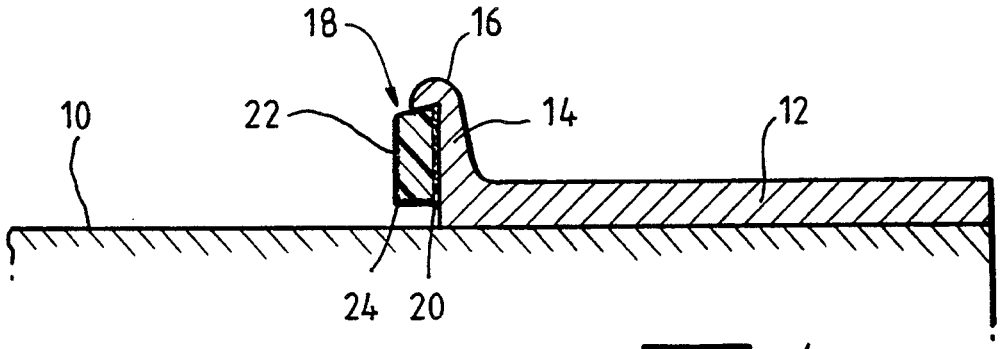
FIG. 1 is a cross section through the raised inner side of a game table incorporating a sound-deadening layer according to the invention.

In FIG. 1, the numeral 10 designates the playing surface of a game table, the numeral 12 denotes a side of a game table, usually composed of extruded metal and fixed to the surface of the game table, the numeral 14 denotes an upwardly directed flange on the inner edge of the side 12, and the numeral 16 denotes an inwardly directed flange or overhang at the upper end of flange 14. The numeral 18 denotes a layer of sound-deadening material adhered to the inner side of flange 14 by a bonding layer of adhesive 20. The numeral 22 denotes a protective layer bonded by bonding layer of adhesive 24 to the inner side of layer 18. The overhang 16 is to prevent or limit removal of the composite layer 18–24 by vandalism and to limit distortion of the sound-deadening layer during contact with a puck or similar object. The bottom edge of layers 18 and 22 are a predetermined distance above the playing surface to accommodate distortion in the layer of sound-deadening material during collisions of pucks with the said layer.

Figure 2:
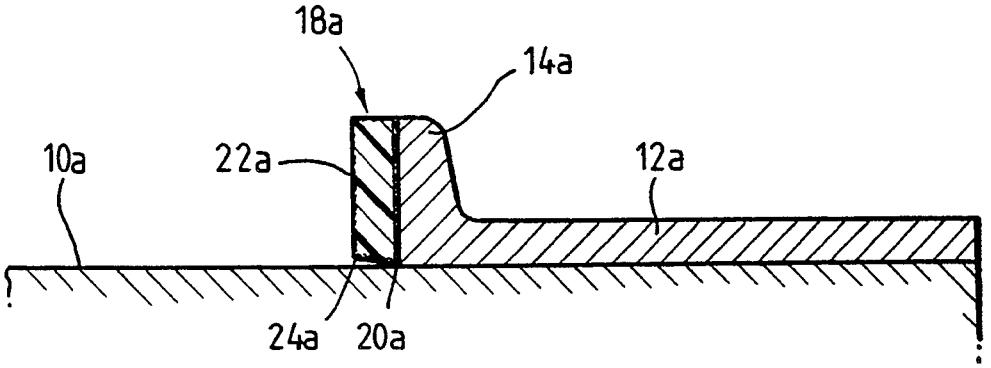
FIG. 2 is a cross sectional view of another embodiment of the invention.
Figure 3:
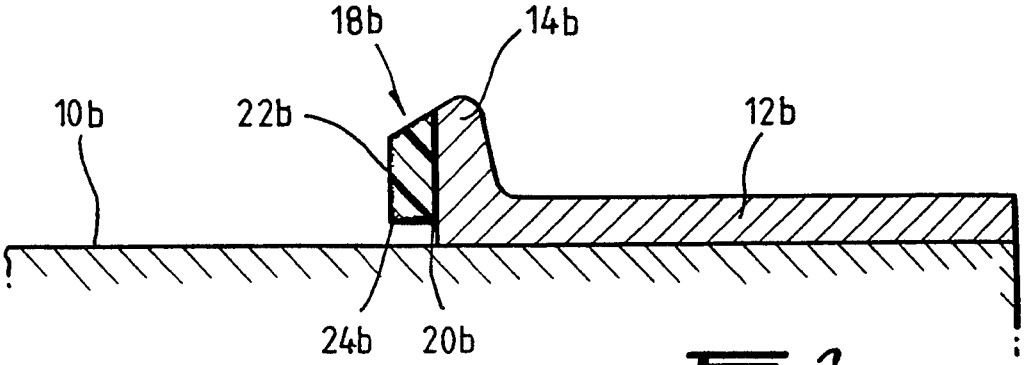
FIG. 3 is a cross section of a further embodiment of the invention.

In FIG. 2 and FIG. 3 numerals 10*a* and 10*b* respectively denote the surfaces of game tables, numerals 12*a* and 12*b* respectively denote a raised side portion of a game table, numerals 14*a* and 14*b* respectively denote an upwardly directed flange on the inner side of side portion 12*a* or 12*b*. Numerals 18*a* and 18*b* respectively denote a layer of sound-deadening material adhered to the inner side of upwardly directed flange 14*a* or 14*b* by bonding layer of adhesive 20*a* or 20*b*. Numerals 22*a* and 22*b* respectively denote protective layers adhered to the opposing free side of sound-deadening layers 18*a* and 18*b* by bonding layers of adhesive 24*a* and 24*b*. In FIG. 2, the sound-deadening layer nearly contacts the surface

10*a* of the game table at a point dose to the inner side of flange 14*a* but is profiled so that the outer part of the lower face of the layer is raised a predetermined distance above surface 10 of the game table. In FIG. 3, it can be seen that the sound-deadening layer terminates at a predetermined distance above the surface 10*b* of the game table. In both cases this permits such distortion of the layer as occurs during collisions to be accommodated.

It is believed that the invention and many of its attendant advantages will be understood from the foregoing description and it will be apparent that various changes may be made in the form, construction and arrangement of the sound-deadening and protective layers and sides of game tables as described herein without departing from the spirit and scope of the invention or sacrificing all of its material advantages, the forms hereinbefore described being merely preferred embodiments thereof.

We claim:

1. A game table for table hockey comprising a planar playing surface bounded by walls having inwardly facing inner sides, the inner sides of said walls being lined with a layer comprising material having satisfactory sound deadening properties and being resilient enough to provide satisfactory rebound of an object when said object strikes said layer, said layer being composed of material selected from polyurethane polymers having a durometer reading of 78±5% on the Shore D Scale or natural or synthetic rubbers having a durometer reading of 40±10% on the Shore A Scale, said walls being formed by upwardly extending flanges provided upon side members mounted on said table, said layer being spaced above said surface.

2. A game table as claimed in claim 1 wherein said layer is secured non-releasably to said inner sides.

3. A game table as claimed in claim 1 wherein said layer is bonded to said inner sides.

4. A game table as claimed in claim 1 wherein said layer is keyed into complementary profiled recesses provided in said inner sides.

5. A game table as claimed in claim 1 wherein said layer is at least 4 mm thick.

6. A game table as claimed in claim 5 wherein said layer in 6 mm thick.

7. A game table as claimed in claim 1 wherein the exposed face of said layer is covered by a protective strip adhered to said exposed face.

8. A game table as claimed in claim 1 wherein said walls are provided with inwardly extending flanges shielding the top face of said layer.

9. A game table as claimed in claim 1 wherein the bottom face of said layer is so profiled that an inner edge of said bottom face is at a predetermined distance above said playing surface.

* * * * *